United States Patent [19]

Jaremco et al.

[11] Patent Number: 4,670,301

[45] Date of Patent: Jun. 2, 1987

[54] METHOD AND APPARATUS FOR COATING THE SPIRAL WELD SEAM OF PIPE

[75] Inventors: Gary J. Jaremco, Vermilion, Canada; David G. Thompson, Northwood, Great Britain

[73] Assignee: Bredero Price, Inc., Houston, Tex.

[21] Appl. No.: 839,559

[22] Filed: Mar. 14, 1986

[51] Int. Cl.[4] ..... B05D 1/12

[52] U.S. Cl. ..... 427/195; 118/307; 118/308; 427/425; 427/286; 427/318

[58] Field of Search ..... 118/307, 308, 323; 427/195, 425, 286, 318

[56] References Cited

U.S. PATENT DOCUMENTS

| | | | |
|---|---|---|---|
| Re. 20,660 | 2/1938 | Schacht | 118/308 |
| 2,368,742 | 2/1945 | Brend | 118/321 |
| 2,373,638 | 4/1945 | Perkins | 118/321 |
| 2,977,928 | 4/1961 | Knutsen et al. | 118/321 |
| 3,687,706 | 8/1972 | Stanley et al. | 118/308 |
| 4,099,481 | 7/1978 | Lyons | 118/8 |
| 4,276,333 | 6/1981 | Cobean | 118/321 |
| 4,343,436 | 8/1982 | Lehmann | 118/308 |

*Primary Examiner*—Shrive P. Beck

*Attorney, Agent, or Firm*—Kokjer, Kircher, Bradley, Wharton, Bowman & Johnson

[57] ABSTRACT

A method and apparatus for coating the helical weld seam extending around a spirally welded pipe is disclosed. Following the application of the usual coating as by a sintered polyethylene coating process, the heated pipe is subjected to a further flow of the coating material from a hopper on a movable coating apparatus. The outlet chute of the hopper is aligned with the pipe and an operator drives a movable carriage carrying the hopper on a rail system extending parallel to the longitudinal axis of the pipe. The speed of movement of the carriage on the track is coordinated with the speed of rotation of the pipe on its longitudinal axis and with the pitch of the weld seam so that the outlet chute of the coating apparatus remains aligned with the weld seam of the pipe. The operator is provided with a lever which controls the material outlet so that a proper flow of coating material can be maintained. If powdered polyethylene is the coating material, the heat of the pipe melts the applied powder over the weld seam to result in an increased increment of coating thickness at this region.

6 Claims, 6 Drawing Figures

METHOD AND APPARATUS FOR COATING THE SPIRAL WELD SEAM OF PIPE

This invention pertains to pipe coating, and more particularly, to a method and apparatus for coating spirally welded pipe with a coating of substantially uniform thickness over the entire pipe outer surface.

Relatively large diameter steel pipe is largely constructed by either of two general procedures. One procedure involves the bending of a rectangular sheet of steel into a tube with the two opposite side edges of the initial sheet in juxtaposition. These edges are welded together to form the pipe tube, resulting in a straight weld seam extending parallel with the longitudinal axis of the tube.

The other procedure for constructing large diameter pipe utilizes a long rectangular strip of steel which is bent in a spiral configuration to define the wall of the pipe. The adjacent edges of the bent strip are welded together resulting in a continuous weld seam extending spirally around the pipe from one end to the other. The steel strip is of uniform width so the pitch of the weld seam is uniform.

One advantage of the spiral welded procedure over the other procedure is the ability to construct pipe in a continuous process from a relatively long coil of strip material. Further, there is a practical limit to the widths at which sheet material can be fabricated at most steel rolling mills. This imposes a practical limit on the maximum diameter of pipe which can be fabricated by the first procedure. The spiral welding procedure can utilize a relatively narrow strip of steel to fabricate pipe of virtually any diameter desired. Hence, pipe utilized in constructing pipelines is often of the spirally welded type.

Pipeline specifications almost invariably require that the pipe be coated with an electrically insulative coating to prevent the adverse effects of electrolysis on the pipe steel. Electrical current flowing between the steel pipeline and the soil, water or other surrounding medium can result in loss of steel from corrosion in a relatively short period of time. Failure of the pipeline from pitting or the like is dangerous, expensive, hazardous to the environment and must be prevented if it is possible to do so.

One type of electrically insulative coating for pipelines which is preferred for some installations is referred to as a "sintered polyethylene coating". This coating is applied individually to the respective joints of pipe at a pipe coating installation prior to the welding of the joints into an elongated string or pipeline. Pursuant to this coating method, each joint is heated in an oven to a predetermined temperature above the melting temperature of polyethylene. The pipe joints are then rotated beneath an elongated curtain of falling powdered polyethylene impinging onto the surface of the hot pipe. The heat of the pipe melts or fuses the particles of powder resulting in a fused continuous smooth polyethylene coating which is bonded to the pipe when the latter cools to below the melting point of the material.

Although pipes coated with this sinter process have a substantially uniform coating thickness over the major cylindrical surface of the pipe, the outwardly protruding weld seam is of steeper contour and the melted coating material tends to flow off the seam before the temperature drops and the coating hardens. This results in a distinctly thinner layer of coating on the weld seam than over the remainder of the pipe surface. The problem is particularly acute with spirally welded pipe because of the substantial length of the helical weld seam. In order to meet the coating thickness specifications, it has heretofore been necessary to coat majority of the pipe surface to a greater thickness than actually required. This is wasteful and expensive.

Accordingly, it is a primary object of this invention to provide a method and apparatus for coating spirally welded pipe wherein the weld seam may be subjected to a coating operation distinct from the primary coating operation so that the thickness of the coating on the weld seam may be augmented without adding to the thickness of the coating on the remainder of the pipe.

Another important object of the present invention is to provide a method and apparatus for applying a sintered polyethylene coating to a spiral pipe weld seam quickly and easily without the necessity for labor intensive and therefore expensive hand coating operations.

Another very important object of this invention is to provide a method and apparatus with which the spiral weld seam of a pipe may be coated through its entire length from a single material outlet opening without the necessity for complicated apparatus to move the opening through a spiral path of travel around the pipe.

These and other important aims and objectives of the present invention will be further explained or will become apparent from the following description, claims and explanation of the drawings, wherein:

Figure 1:
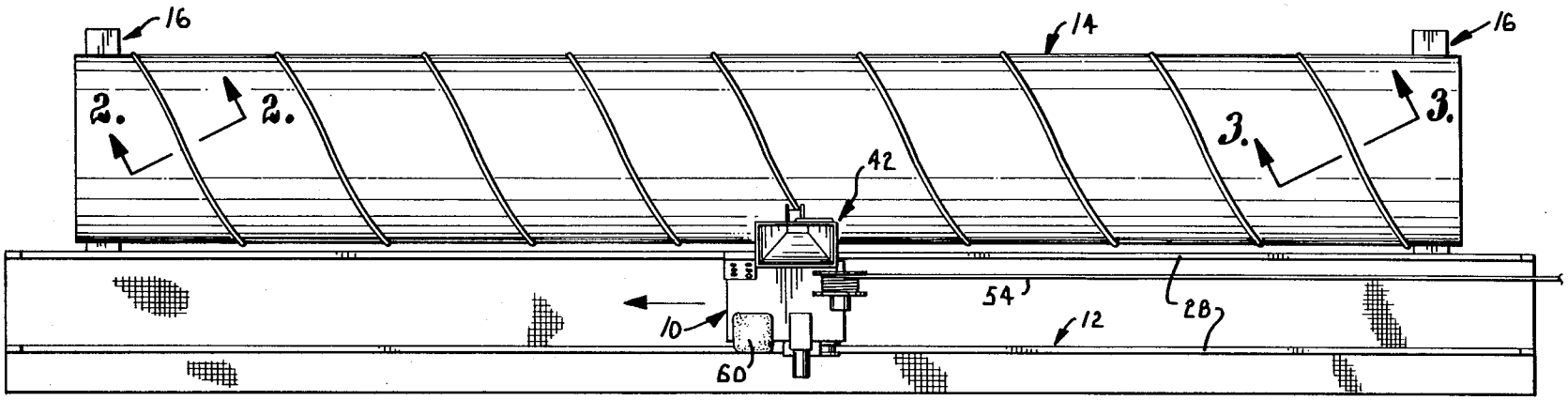
FIG. 1 is a top plan view of coating apparatus embodying the principles of this invention and showing a pipe joint in position to be coated.
Figure 6:
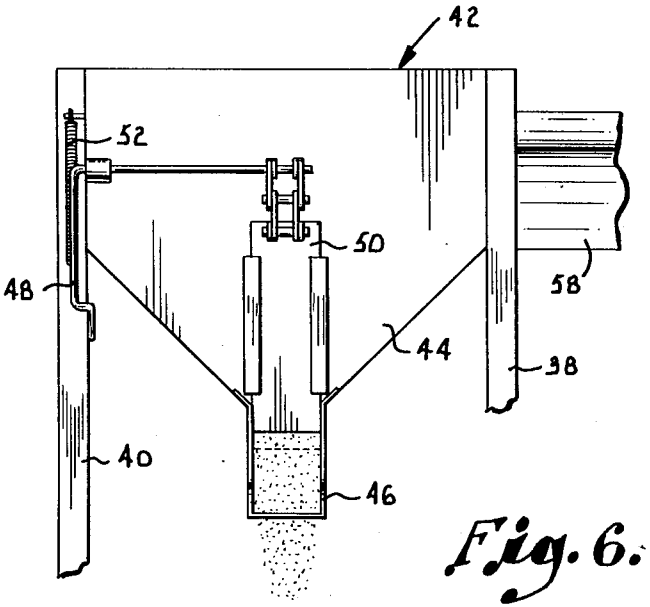
FIG. 6 is a fragmentary elevational view taken along line 6—6 of FIG. 5.
Figure 5:
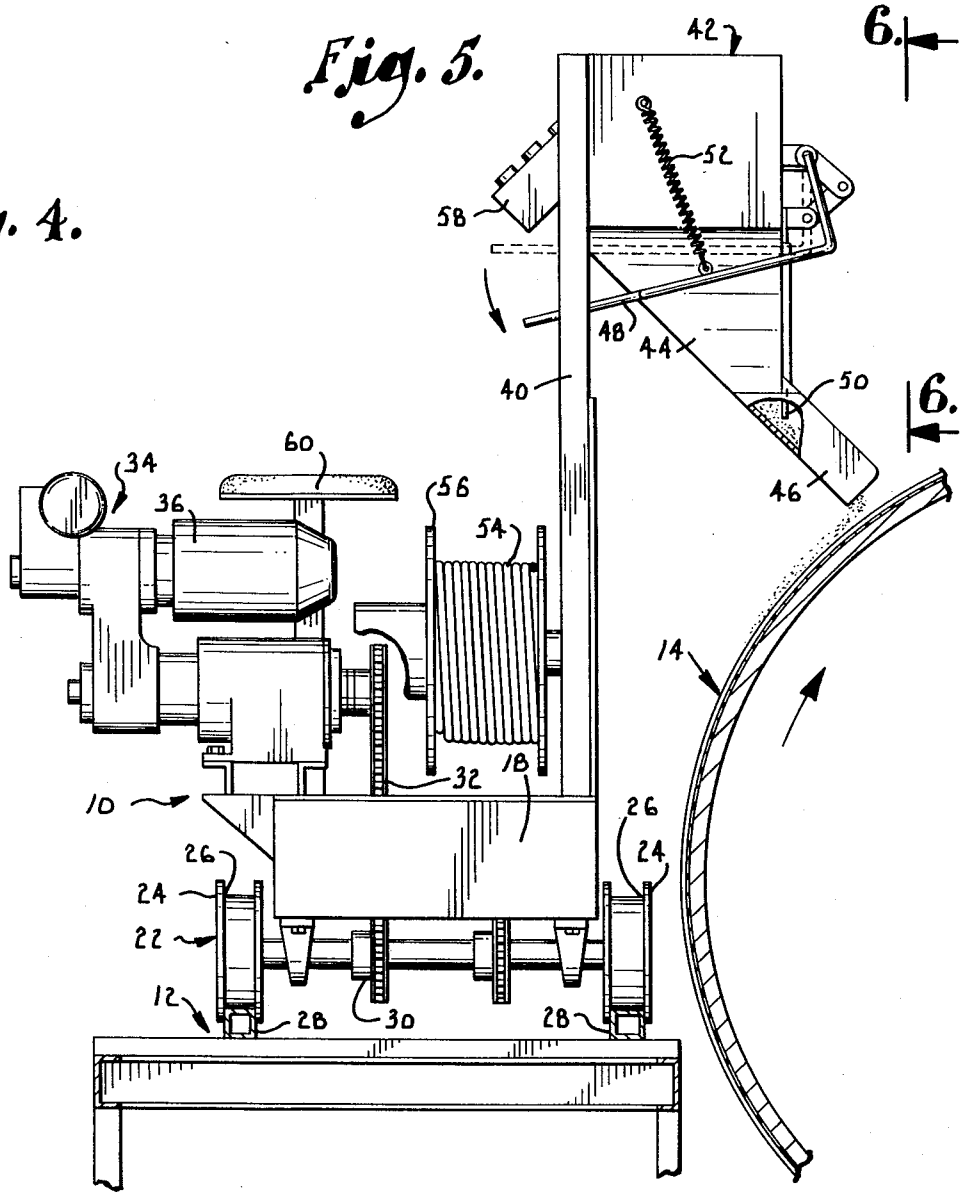
FIG. 5 is a fragmentary, detailed cross-sectional view taken from line 5—5 of FIG. 4, parts being broken away and shown in cross-section to reveal details of construction.
Figure 4:
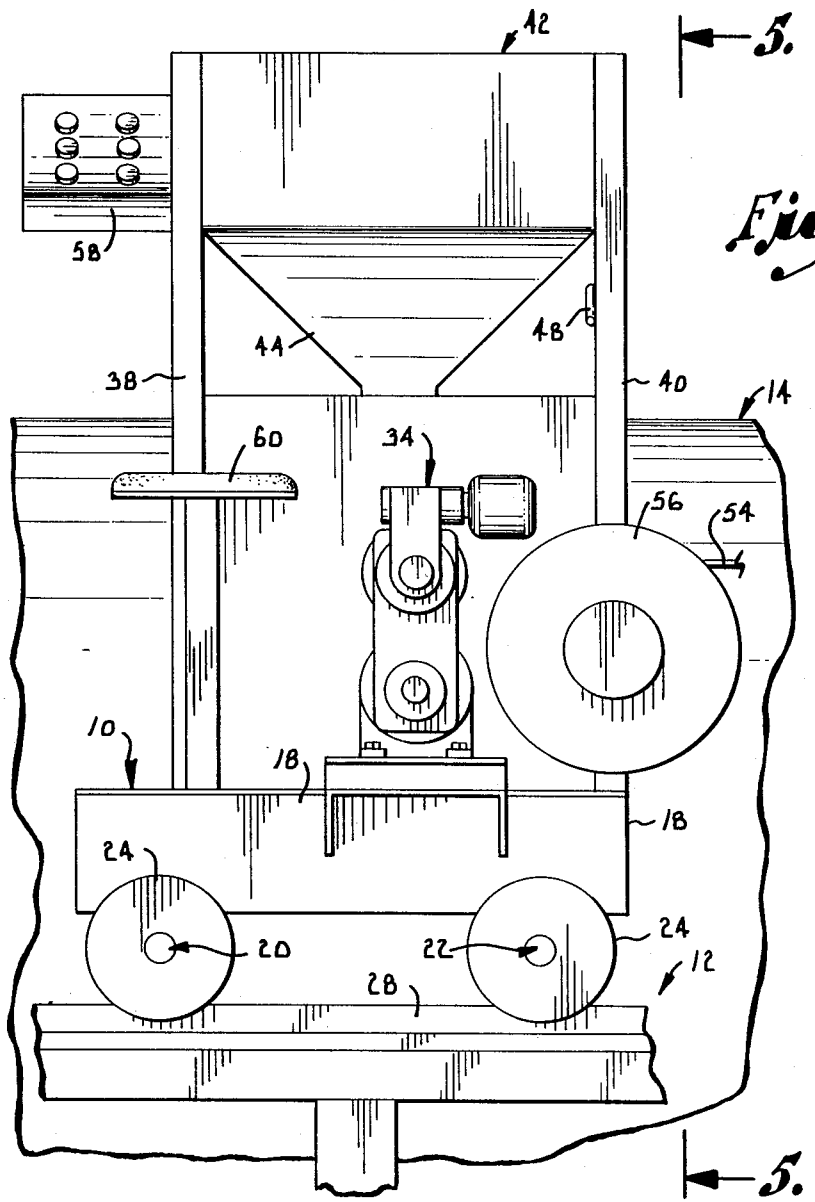
FIG. 4 is an enlarged, fragmentary side elevational view of a pipe coating plant illustrating a weld seam coating carriage embodying the principles of this invention.

Apparatus for carrying the principles of this invention into effect include a carriage 10 movable on a track 12 adjacent a pipe joint 14 supported for rotation on its longitudinal axis by spaced apart pairs of support rollers 16 as illustrated in FIG. 1 of the drawing. Carriage 10 includes a frame 18 supported by a pair of wheel and axle assemblies 20 and 22 as shown in FIGS. 4 and 5. The wheels 24 of the assemblies 20 and 22 may be identical and each is provided with a circumferential groove 26 adapting the wheels to run on a pair of parallel, spaced apart, elongated rails 28 extending adjacent pipe 14 throughout at least the entire length of the latter and parallel to the longitudinal axis of the pipe.

One of the assemblies 20 or 22 has a drive sprocket 30 which accommodates a drive chain 32 operably coupled with the power outlet of a variable drive gear assembly 34 powered by an electric motor 36. Manifestly, motor 36 provides the driving force for moving carriage 10 in either direction on track 12.

Upright standards 38 and 40 carried at one side of carriage 10 support a hopper 42 in an elevated position above and extending partially over the pipe 14. The lowermost portion 44 of hopper 42 has an inclined bottom projecting downwardly and in the direction of the pipe. Portion 44 terminates in a chute 46 overlying the pipe as illustrated in FIG. 5.

A pivoted lever 48 on hopper 42 is operably coupled with a vertically sliding gate 50 controlling the outlet opening of the hopper. A spring 52 having one end connected with lever 48 and the other end attached to the side wall of hopper 42 exerts a biasing force on the lever in a direction to close gate 50. The gate can be moved to its open position by manually swinging lever 48 as illustrated in the arrow in FIG. 5. The flow of material emanating from hopper 42 by gravity may be readily adjusted by the position of lever 48 as will be understood.

Power for operating motor 36 is supplied by a cable 54 coupled with a power source and wound on a reel 56. Reel 56 is mounted on upright standard 40 and is provided with an internal spring which automatically rotates the reel in a direction to take up any slack in the cable, yet which yields to permit unwinding of the cable as is necessary to permit movement of carriage 10 on its track.

A control panel 58 is connected through wiring (not shown) to the motor and variable drive to enable an operator on seat 60 carried by carriage 10 to control the movements of the carriage. The operator also controls the flow of coating material from hopper 42 by means of lever 48. In the embodiment of the apparatus illustrated, the control panel mounts six control buttons. Two of the buttons are used for the "power on" and "power off" conditions. One button slows the speed of the carriage by controlling assembly 34 and a similar button speeds the carriage in a similar manner. The remaining two buttons are available to cause the movement of the carriage in one direction or the other respectively on track 12.

A spirally welded pipe to be coated in accordance with the principles of this invention may be first provided with an electrically insulative coating of sintered polyethylene in a conventional manner. Thus, the pipe, after having been cleaned of all rust scale and the like by shot blasting or other suitable process, is conveyed into a heating oven where the steel of the pipe is elevated to a temperature above the melting point of the polyethylene coating material. The material typically is a powdered polyethylene wherein the particles of polyethylene are ground to a predetermined particle size distribution. One size distribution which has been found satisfactory results in a sieve analysis wherein about 15% of the particles have a size range of from 400–600 microns, about 57% of the particles have a size range from 200–400 microns and about 28% of the particles have a size of less than 200 microns. This material produces a bulk density of from about 0.30 grams per cubic centimeter to about 0.39 grams per cubic centimeter.

The steel pipe is heated in the oven to a temperature from about 300° C. to about 340° C. More specifically, it has been found that the process works advantageously if the temperature of the pipe is elevated to from 316° C. to about 329° C.

Once the pipe has been elevated to a temperature as specified, the pipe is moved laterally from the oven where it is rotated in a horizontal disposition about its longitudinal axis. As the hot pipe is rotating on its axis, an elongated, curtain of powdered polyethylene extending the entire length of the pipe joint is gravitated or otherwise projected onto the hot pipe surface. The heat of the pipe melts the polyethylene particles which become sticky and adhere to the outer surface of the pipe. This results in the build up of a generally uniform coating of whatever thickness may be specified for the pipe as dictated by the service in which the pipe will be used.

Some of the particles of polyethylene may not adhere to the pipe surface and these may gravitate to the bottom of the coating station from whence they can be recycled for use in the subsequent coating of other joints of pipe. Further, some of the particles impinging on the pipe do not melt instantaneously and the coating may have a relatively rough, nonhomogeneous texture immediately following the termination of the flow of powdered polyethylene onto the pipe. Accordingly, it is conventional practice to continue the rotation of the pipe for some further increment of time to permit the heat of the pipe to permeate through the applied coating so that a smooth, homogeneous coat over the pipe surface is achieved. The steel of the pipe tends to retain its heat for a substantial period of time so that it retains sufficient heat for melting the polyethylene applied to the pipe for a relatively long period of time.

Figure 2:
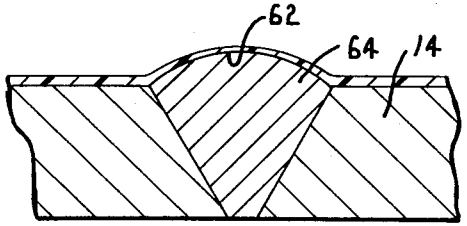
FIG. 2 is an enlarged, fragmentary cross-sectional view taken along line 2—2 of FIG. 1.

While the coating thickness may be relatively uniform over the major cylindrical surface of the pipe as a result of the sintered coating process just described, the thickness over the weld seam is usually somewhat less as heretofore explained. This is illustrated graphically in FIG. 2 of the drawing. It will be apparent that the relatively steep convex top 62 of the weld material 64 causes the coating material to flow from this region toward the major cylindrical surface of the pipe. This is exacerbated by the heat of the pipe which maintains the coating at a temperature above its melting point for some period of time after the coating has been applied. This time interval gives the melted coating an opportunity to flow by gravity to the adjacent, flatter region.

The method of the present invention is carried out while the pipe is still rotating on its longitudinal axis and while it contains sufficient residual heat to melt the polyethylene powder. Carriage 10 is moved to one end of the pipe to apply a second flow of coating material only to the weld seam. The operator drives the carriage to a position wherein the chute 46 is aligned with the weld seam and powdered polyethylene (which may be identical to that previously described) may be allowed to flow directly onto the weld seam. The operator opens the gate to permit the flow and simultaneously operates the carriage so that it moves along track 12 longitudinally of the pipe at a rate of speed coordinated with the speed of rotation of the pipe and with the pitch of the spirally extending weld seam. Inasmuch as the speed of rotation of the pipe remains constant and the pitch of the weld seam is substantially uniform, it has been found that the operator can coordinate this movement by use of the control buttons without substantial difficulty. This coordination insures that the material is flowed onto the weld seam to the exclusion of the major cylindrical surface of the pipe. The operator is able to adjust the rate of flow of coating material by moving the lever to vary the gate opening as will be readily understood.

Figure 3:
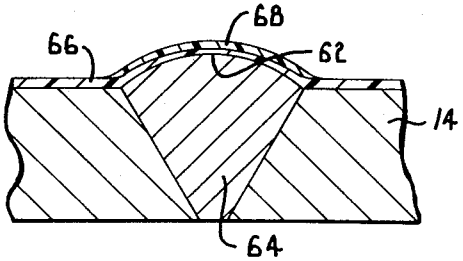
FIG. 3 is a view similar to FIG. 2 but taken along line 3—3 of FIG. 1 to illustrate the augmented coating thickness at the weld seam.

The coating operation continues in this manner along the weld seam throughout the entire length of the pipe and before the pipe has cooled to an extent that it is incapable of melting the applied powder. This final application of coating material directly to the weld seam has the effect of increasing the thickness of the coating 66 by an increment 68 over the weld seam as illustrated graphically in FIG. 3. This results in a coating of uniform thickness over the entire pipe, including over the weld seam of the pipe.

The rate of flow of polyethylene powder which is appropriate may vary. The flow should be sufficient to provide adequate material to at least increase the coating on the weld seam by the amount desired. For pipe of about 48" diameter, rotating at a speed of about 4.8 RPM, a flow of 8.5 kgs/min. has been found to be satisfactory. Obviously, this rate will also depend on the physical characteristics of the weld seam itself. The operator can visually determine the flow rate appropriate for most circumstances.

Although the invention has been described specifically in relation to use in a sintered polyethylene coating process, it will be readily understood by those skilled in the art that the utility of the invention need not be so limited. For example, the principles herein explained could be utilized with a variety of other coating processes wherein it is necessary to apply additional coating material to the weld seam region of a spirally welded pipe. The disclosure should be interpreted as embracing such modifications as are reasonably within the skill of those in the relevant art.

Having thus described the invention, we claim:

1. A method of coating the weld seam of substantially uniform pitch on the outer surface of spirally welded pipe, said method comprising:

rotating the pipe at a predetermined speed on its longitudinal axis adjacent a coating station;

aligning the coating station with the pipe weld seam at a point along the latter;

moving the coating station longitudinally along the pipe path of travel parallel with the pipe axis at a linear rate of speed coordinated with the pitch of the weld seam and the speed of rotation of the pipe to maintain the alignment of the coating station with the weld seam during said movement of the coating station; and applying a coating material from the coating station onto the weld seam during said movement of the coating station.

2. A method of coating the weld seam of elongated spiral welded cylindrical pipe having a weld seam extending longitudinally of the pipe in a helix of substantially uniform pitch around the pipe, said method comprising:

rotating the pipe at a predetermined speed on its longitudinal axis adjacent a coating station;

progressively moving the coating station longitudinally along the pipe on a path of travel parallel with said pipe axis and at a speed coordinated with both the rotation speed of the pipe and the pitch of said weld seam whereby the coating station is moved progressively along the seam; and applying coating material to the seam as the coating station is moved along the latter.

3. A method of coating steel spirally welded pipe of substantially cylindrical configuration and having a raised weld seam of relative steep contour extending longitudinally of the pipe in a spiral of substantially uniform pitch, said method comprising:

heating the pipe to a temperature of from between about 300° C. to about 340° C.;

immediately following the heating step, rotating the pipe about its longitudinal axis with the latter in substantially horizontal disposition;

while the pipe is rotating, flowing a stream of particulate polyethylene coating material over the entire outer surface of the pipe for a sufficient time interval to build up on the cylindrical surface of the pipe a uniform thickness of coating of polyethylene melted by the heat of the pipe, the thickness of the coating over the spiral weld seam being inherently less than on said cylindrical surface as a result of increased flow of the melted material due to the relatively steeper contour of the weld seam;

terminating the stream of particulate coating material over the entire surface of the pipe and continuing the rotation of the pipe; and before the temperature of the pipe has cooled to below that required to melt the coating material, flowing a second stream of said particulate coating material on substantially only the weld seam of the pipe to increase the coating thickness on the weld seam, by aligning said second stream with the weld seam and progressively moving said second stream longitudinally of the pipe on a path of travel parallel with the pipe axis and at a speed coordinated with the speed of rotation of the pipe and with the pitch of the weld seam whereby the stream remains directed at said weld seam; and continuing to rotate the pipe until the pipe and the melted coating material cools to a temperature below the melting point of the material.

4. The method as set forth in claim 3, wherein said pipe is heated to a temperature of between about 316° C. to about 329° C.

5. The method as set forth in claim 3, wherein the coating material is polyethylene ground to a powder having a bulk density of from about 0.30 to about 0.39 grams per cubic centimeter.

6. The method as set forth in claim 5, wherein the powdered polyethylene has a particle size distribution of:

400–600 microns —about 15%
200–400 microns —about 57%
less than 200 microns —about 28%.

* * * * *